US006428098B1

(12) United States Patent
Allbaugh

(10) Patent No.: US 6,428,098 B1
(45) Date of Patent: Aug. 6, 2002

(54) CHILD SEAT LINER

(76) Inventor: Florence B. Allbaugh, 7 Sawtooth Ct., Hilton Head Island, SC (US) 29926

( * ) Notice: Subject to any disclaimer, the term of this patent is extended or adjusted under 35 U.S.C. 154(b) by 0 days.

(21) Appl. No.: 09/669,210

(22) Filed: Sep. 25, 2000

Related U.S. Application Data

(60) Provisional application No. 60/165,801, filed on Nov. 16, 1999.

(51) Int. Cl.[7] ..... A47C 31/00

(52) U.S. Cl. ..... 297/219.12; 297/250.1

(58) Field of Search ..... 297/256.17, 250.1, 297/219.12; 5/417, 485, 420

(56) References Cited

U.S. PATENT DOCUMENTS

| | | | | | |
|---|---|---|---|---|---|
| 2,254,466 | A | * | 9/1941 | Albert | 297/225 |
| 4,188,065 | A | | 2/1980 | Meeker | |
| 4,478,453 | A | | 10/1984 | Schutz | |
| D283,475 | S | | 4/1986 | Reece | |
| 4,621,004 | A | * | 11/1986 | Madsen | 428/20 |
| 4,891,454 | A | | 1/1990 | Perdelwitz, Jr. et al. | |
| 4,892,769 | A | * | 1/1990 | Perdelwitz, Jr. et al. | 428/68 |
| 5,330,250 | A | * | 7/1994 | Reyes | 297/229 |
| 5,431,478 | A | | 7/1995 | Noonan | |
| 5,678,888 | A | * | 10/1997 | Sowell et al. | 297/256.17 |
| 5,829,835 | A | * | 11/1998 | Rogers et al. | 297/256.17 |
| 5,987,667 | A | * | 11/1999 | Haverly et al. | 5/485 |
| 6,083,212 | A | | 7/2000 | Kumasaka | |
| 6,142,565 | A | * | 11/2000 | Rieder | 297/219.12 |
| 6,224,152 | B1 | * | 5/2001 | Hughes et al. | 297/256.17 |

* cited by examiner

*Primary Examiner*—Peter M. Cuomo
*Assistant Examiner*—Stephanie Harris
(74) *Attorney, Agent, or Firm*—Harleston Law Firm, LLC; Kathleen M. Harleston

(57) ABSTRACT

A one-piece, flexible liner for a high chair or other type of child seat, includes: a) a central, generally square-shaped seat portion; b) a pair of arm portions extending from opposite sides of the seat portion; c) a front portion extending from a third side of the seat portion; d) a generally rectangular-shaped back portion extending from a fourth side of the seat portion opposite to the front portion; e) one or more fastening mechanisms for detachably attaching the liner to the high chair or child seat; and f) a storage pouch, which is a part of the liner, for holding the folded liner. The present invention also encompasses a disposable seat liner which includes: (a) an upper layer of flexible, liquid-permeable sheet material; (b) a middle layer of an absorbent core material; (c) a lower layer of liquid impermeable material, and (d) a detachable adhesive on the lower layer for contacting the chair seat. A method for folding a one-piece liner into an attached storage pouch is also included herein.

20 Claims, 9 Drawing Sheets

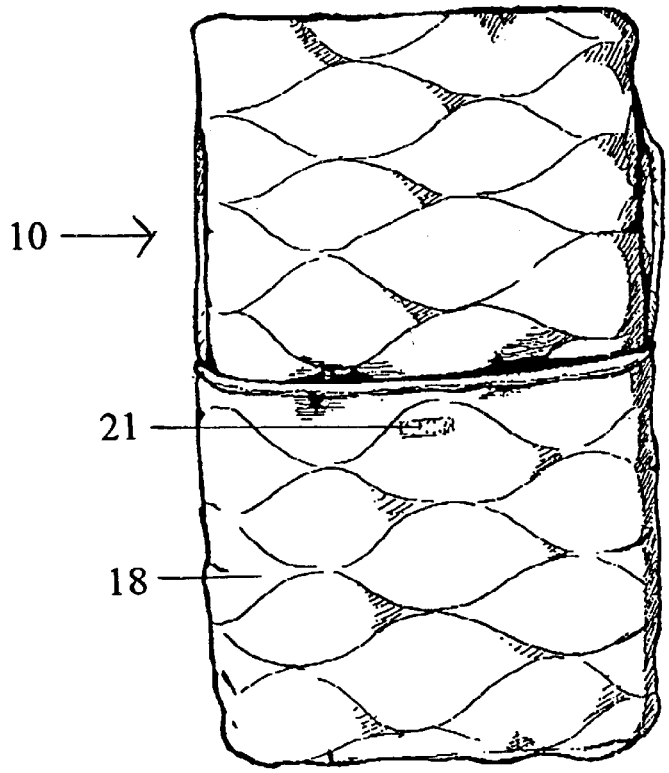
FIG. 10
FIG. 11
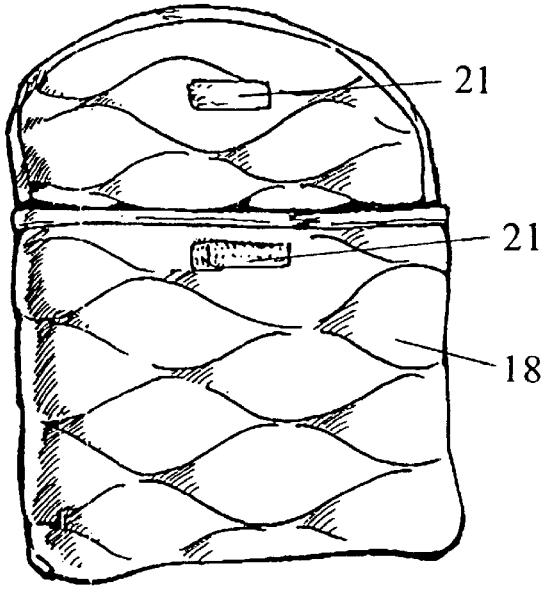

CHILD SEAT LINER

CROSS REFERENCE TO RELATED APPLICATIONS

Benefit is claimed under 35 USC 119(e) of provisional U.S. patent application Ser. No. 60/165,801, filed on Nov. 16, 1999.

BACKGROUND OF THE INVENTION

1. Technical Field

The present device relates generally to a disposable or reusable, removable, foldable liner for a child's seat, such as a high chair, baby stroller, child's seat of a shopping cart, child's chair, baby carrier, or portable baby/child seat, or a baby changing table.

2. Background Information

Restaurant high chairs are ordinarily stable to avoid tipping, simple and unfoldable to avoid accidents, such as pinching of the baby's fingers, and durable so that they can be moved around and used by many different babies and parents. The high chair can be pulled up to the restaurant table, or the high chair may come with a tray which fits over the arms. These high chairs are often stackable to conserve space in the restaurant. The footrest comes in handy to help unstack high chairs. When several high chairs are stuck on top of one another, an adult can put a foot on the footrest and push down while pulling up on a high chair arm with a free hand. The adult's other hand is often tied up holding the baby.

The typical wooden high chair is relatively wide compared with many high chairs found in residences, which are available in wide variety. Smaller babies and infants can slip out of these wide high chairs. When the baby is an infant, many of the wooden restaurant high chairs can be upended and an infant carrier can be placed between the legs of the high chair. Babies should, of course, always be supervised while in any high chair.

There are several problems with these wooden high chairs, the predominant one being how unsanitary they often are. High chairs in restaurants are used several times each day by different babies. Parents are a captive audience; it is impractical to bring one's own high chair to a restaurant. Babies often gum high chair bars, railings and seat belts, which can become twisted and filthy. Parents are often not as conscientious about maintaining a restaurant's high chairs. Restaurant workers may be busy and often do not realize the importance of wiping down high chairs after each use.

Another problem is the leftover food crumbs, smears and spills left behind when the baby and family are finished and are ready to leave the restaurant. Of course, some babies are neat when they eat, but others play happily with their food. The parent/caretaker does not have cleaning tools and access to a sink so that he or she can clean up after the baby eats. She, or he, often does not have the time to clean up, either. A big tip somehow does not soften the embarrassment of leaving a big mess behind in a restaurant.

The present invention is a disposable or reusable, portable seat liner, or cover, for wooden high chairs or other, similar types of childrens' seats. This seat cover largely avoids the problem of unsanitary restaurant high chairs by keeping the child's body from contacting the surface of the high chair. This seat cover can be laid out flat for cleaning by hand, or washed in a washing machine and dried. The present reusable high chair cover has an open position for use on a high chair or other type of child's seat, and a closed position for storage. It folds into a compact, aerated pocket bag shape for transportation to and from the restaurant. The pocket can be used for storage of toys, blankets, pacifiers, bibs, etc. while the seat cover is in place on a high chair. This seat cover device can easily be assembled on a high chair, and folded up quickly for carrying away from the restaurant. Much of the mess can be carried away in this seat cover, which can be cleaned later. The seat cover includes a clip mechanism for attaching a pacifier so that it is less likely to be lost. The seat cover of the present invention also helps to prevent the baby from slipping out of the high chair.

BRIEF SUMMARY OF THE INVENTION

The present invention is a one piece, flexible liner, or cover, for a high chair or any other type of child's seat. It includes:

a) a central, generally square-shaped seat portion;

b) a pair of arm portions extending from opposite sides of the seat portion;

c) a front portion extending from a third side of the seat portion;

d) a generally rectangular-shaped back portion extending from a fourth side of the seat portion opposite to the front portion;

e) one or more fastening mechanisms for detachably attaching the liner to the high chair or child seat; and f) a storage pouch extending continuously from an end of the back portion. When the liner is in use, the seat portion rests on the seat of the high chair or child seat, each arm portion extends over an arm of the high chair or child seat, the front portion extends down from the seat of the high chair or child seat, the back portion is positioned on the back of the high chair or child seat, and the storage pouch extends over the back of the high chair or child seat; and, when the liner is folded, it fits into the storage pouch.

The present invention also encompasses a disposable liner for a high chair or other type of child seat having a generally rectangular-shaped seat portion bordered by a back portion on one side, a front portion on an opposite side, and two arm portions on opposite sides of the seat portion. The disposable liner includes: (a) an upper layer of flexible, liquid permeable sheet material; (b) a middle layer of an absorbent core material; and (c) a lower layer of liquid impermeable material. The outside of the lower layer includes a detachable adhesive adapted for contacting the high chair seat. Also included herein is a method for folding a one-piece child seat liner into a storage pouch, which is part of the liner.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein:

FIGS. 6–10 are top plan views of a liner according to FIG. 5, showing a folding sequence;

FIG. 11 is a top plan view of a storage pouch of a liner according to the present invention;

DETAILED DESCRIPTION OF THE INVENTION

Figure 1:
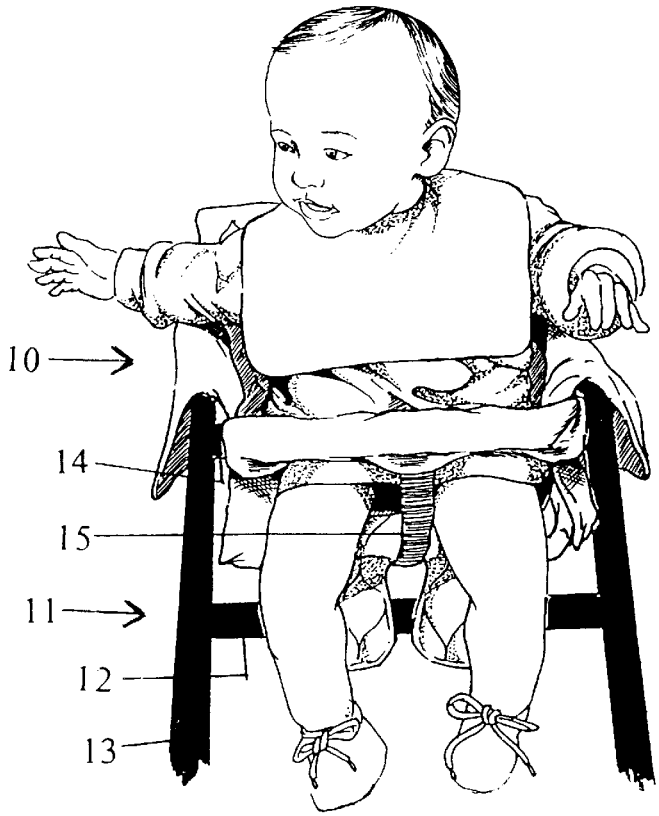
FIG. 1 is a front elevational view of a high chair liner according to the present invention.

In the following description, like reference characters designate like or corresponding parts throughout the several views. Also, in the following description, it is to be understood that such terms as "front," "back," "under," and the like are words of convenience and are not to be construed as limiting terms. Referring in more detail to the drawings, the invention will now be described.

Referring to FIG. 1, a cover, or liner 10, for a high chair or other type of child seat according to the present invention is shown in use in a wooden high chair 11, with a baby sitting in it. The high chair/child seat liner of the present invention is especially suited for use with wooden high chairs typically found in many restaurants. However, it is also adaptable for use in almost any seat for a baby, toddler or older child, such as a child's chair, baby carrier, child's seat of a shopping cart, portable baby seat, baby stroller, or restroom changing table.

A conventional high chair found in many restaurants, which is shown in FIG. 1, has a relatively wide base stand with four legs and two arms. The backs of the arms are attached to a rigid, generally vertical back, which is attached to a sturdy, flat, horizontal seat. A footrest 12 for older babies is often provided. The footrest usually extends horizontally between the two front legs 13. A horizontal lap bar 14 extends across the front of the seat between the vertical fronts of the high chair arms. A durable lap strap 15 often extends down vertically from the lap bar to the middle of the front of the seat. The babies' legs are placed under the lap bar and on either side of the strap, as shown in FIG. 1. The function of the lap bar and strap is to help prevent the baby, especially young babies, from slipping out of the seat. A seat belt is also often included in the high chair.

Figure 2:
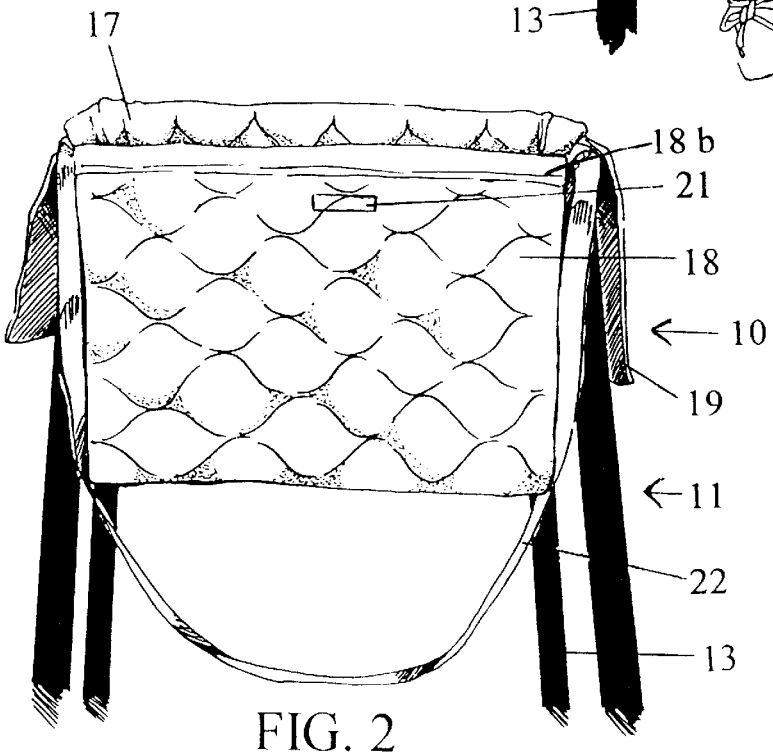
FIG. 2 is a rear elevational view of a high chair liner according to the present invention.
Figure 3:
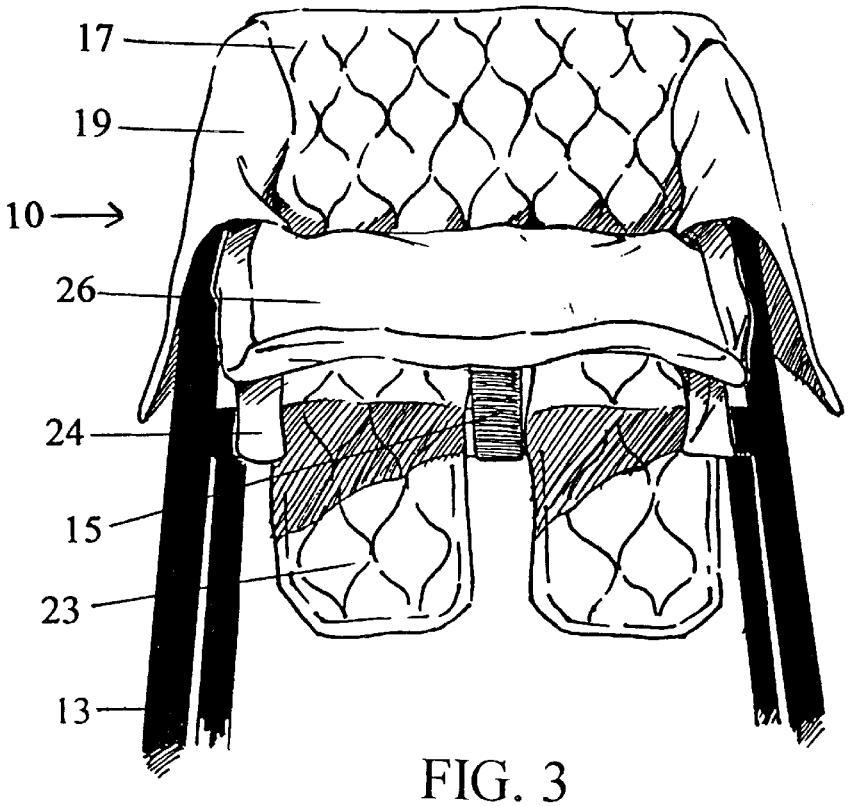
FIG. 3 is a front elevational view of a high chair liner according to FIG. 2.
Figure 4:
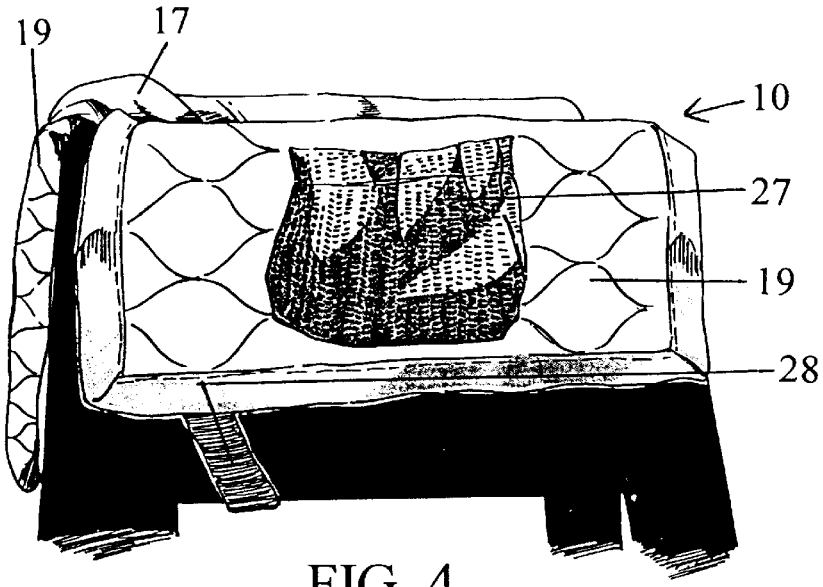
FIG. 4 is a side elevational view of a high chair liner according to FIG. 2.
Figure 5:
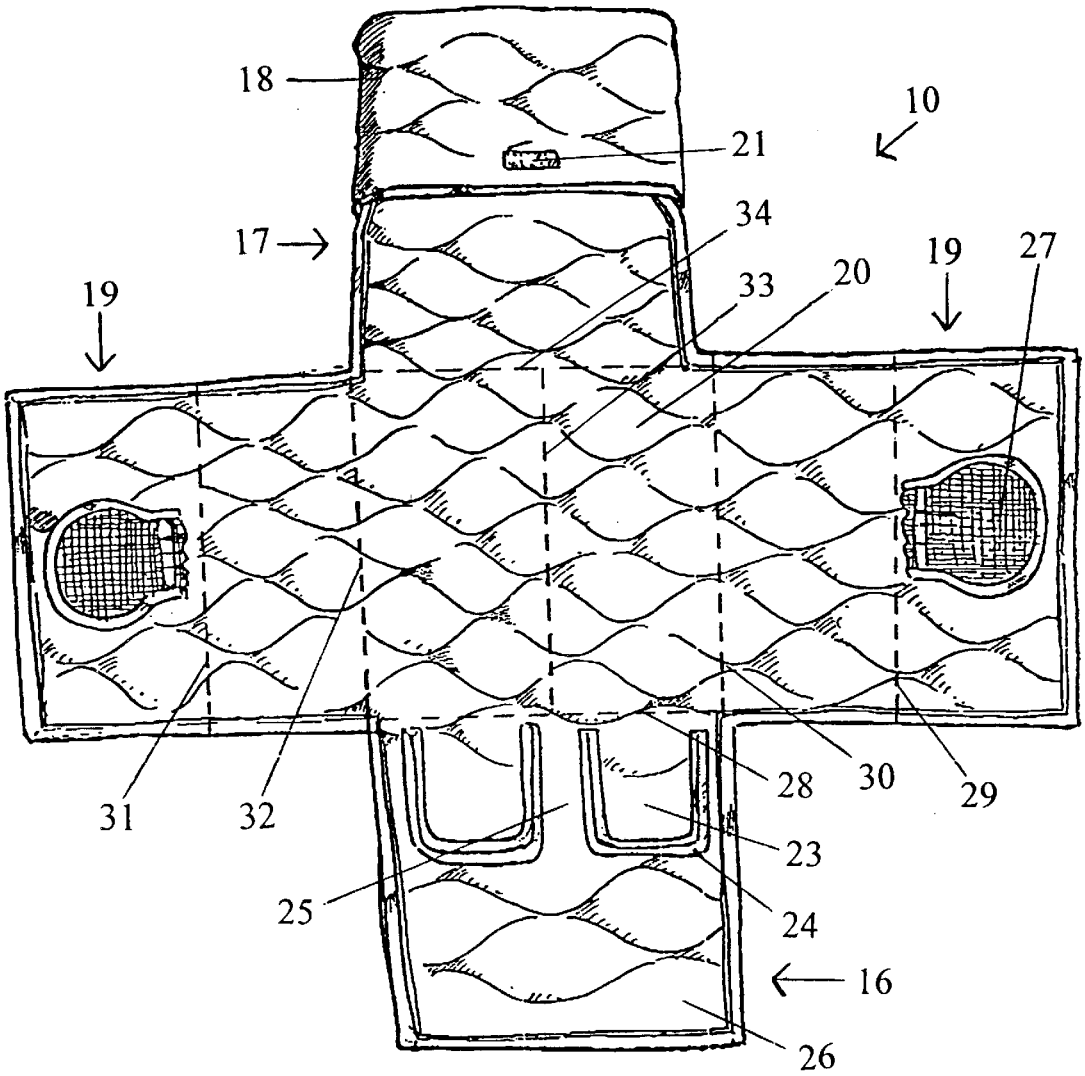
FIG. 5 is a top plan view of a chair/seat liner according to the present invention.

Referring to FIGS. 2–5, the liner 10 is shown in place on a high chair 11 from the rear (FIG. 2), the front (FIG. 3), and the side (FIG. 4). FIG. 5 shows a liner 10 laid out on a flat surface. The liner 10 is generally cross-shaped and is symmetrical about its longitudinal center line. The liner 10 can be divided into five areas: a front portion 16, a back portion 17, a storage pouch 18 extending from the back portion, two matching arm portions 19, and a central seat portion 20. The generally square-shaped central seat portion 20 is contiguous with the arm portions 19 on two of its opposite sides, the back portion 17 on a third side, and the front portion 16 on its fourth side. The seat portion 20 is placed on the high chair or child seat when the liner 10 is in use.

Storage Pouch

Referring to FIGS. 2 and 5, when the liner 10 is in use, the storage pouch 18 hangs over the back of the high chair, where its opening is accessible to the caregiver. The pouch opening **18*b* is at the top of the storage pouch 18 and the chair. When the liner is in place on the high chair, the storage pouch can be used to store items such as a baby bottle, baby sanitary wipes, an extra disposable diaper, toys, etc. The front of the storage pouch is optionally made of a mesh material so that the contents can be viewed. The mesh on the front of the storage pouch also allows air to circulate through to reduce mustiness, which can occur when the liner is stored for several months or more. The back of the storage pouch 18 is contiguous with the back portion 17 along its bottom edge. The pouch is constructed by sewing a rectangular piece of material along the edges onto the front face of the end of the liner. The two sides form the pouch, and the top edges are left open to form the opening to the pouch. The pouch is then inverted, or folded back on itself, so that its opening faces up for handy temporary storage of items when the liner is in use, and for storing the liner when it is not in use. Alternatively, the storage pouch is constructed by simply flipping the end section of a long back portion up onto itself and sewing along the side edges, leaving the top edge open. The liner is optionally comprised of two layers of fabric overlaid on one another, with a seam sewn along the edges, and the storage pouch is an inverted end of the back portion. If there is a storage pouch flap, it will extend from the end of the back of the pouch over the opening to the pouch. The pouch preferably includes corresponding fastener members secured to the pouch flap and the face of the storage pouch, such as corresponding lock and loop strips 21, as shown in FIGS. 2 and 5**.

Continuing with FIG. 2, the liner 10 is also unique in that it can be folded into the storage pouch 18, which is itself part of the liner, when it is not in use on the high chair. The entire liner 10 folds into the storage pouch for easy transportation and storage. The liner may include a carrying strap 22 for carrying the storage pouch with the liner in it. The carrying strap 22 is ordinarily attached to the liner at opposite ends of the storage pouch 18, as shown in FIG. 2. The carrying strap should be arranged to fall behind the high chair when the liner is in use. It may be a long shoulder strap, as shown, or a shorter strap which can be held in the hand.

Leg Panels

Referring to FIGS. 3 and 5, the front portion 16 of the seat liner 10 comprises two identical leg panels 23, which are cut out from the front portion so each of the baby's legs can be placed through a leg panel slot when the liner is on the high chair. The leg panels 23 protect the baby's thighs from the seat and make him or her more comfortable in the chair over time. The corresponding leg panel slots 24 are preferably generally U-shaped and spaced apart, with one on either side of a longitudinal center line of the liner. The two ends of each U-shaped leg panel border on a first latitudinal fold line 28, which is shown in FIG. 5, between the seat portion 20 and the front portion 16, so that the leg panels hang down from the seat when the liner is on the high chair. The edges of the leg panels 23, and the corresponding leg panel slots 24 in the liner, are preferably edged with seam binding so that they are durable and do not unravel. The edges of the entire liner are preferably finished with seam binding for the same reason.

Once the liner has been placed in the high chair, the baby is seated in the high chair on the liner. First, the baby's legs are placed through the two slots 24 in the liner. When the liner is in use, the thin crotch section 25 of liner between the leg panel slots 24 goes between the baby's legs behind where the high chair lap strap 15 normally is.

Lap Bar Flap

Continuing with FIGS. 3 and 5, the remainder of the front portion 16, called here a lap bar flap 26, flaps up and over the horizontal lap bar 14 of the high chair. This lap bar flap 26 protects the front of the child and the floor from spills. It also insulates the child from "germs" and physical harm from the lap bar 14, which many babies like to grasp and bite down on. This lap bar flap preferably attaches around the lap bar by fastening means, such as lock and loop strips, on the underside, so that the flap does not hang loose. The lap bar flap 26 is shown loose in FIG. 3, and fastened around the lap bar in FIG. 1.

Arm Portions

As shown in FIG. 4, when the liner is in use, the two arm portions 19 extend upwardly from opposite sides of the seat portion 20 and drape over the high chair arms. The arm portions 19 insulate the baby from contact with the sides of the high chair and help to protect her from inserting her fingers into apertures in the high chair. The arm portions may have corresponding strips of lock and loop, snap members, or other fastening mechanisms attached for fastening the flap over the high chair arm to the remainder of the arm portion. In the illustrated embodiment, side pockets 27 are disposed on the left and right arm portions 19. The side pockets 27 are open at the top for storage of toys for the child or other items. The front of each side pocket is preferably made of a netting material so that the pocket's contents are largely visible from outside the pocket. A piece of elastic (preferred), or a zipper (not shown), may traverse a portion of the pocket perimeter. It is also contemplated that other closure devices, such as lock and loop or snaps, can replace the elastic or zipper. In an alternate embodiment, no side pockets are provided.

The high chair liner of the present invention is one-piece for easy folding, transportation and storage. In a preferred embodiment, it is cross-shaped and made of a washable, woven fabric, such as cotton canvas, polyester, or a cotton/polyester blend, that is foldable, durable, comfortable, and washable. It is preferably padded with polyester fill or made of a quilted type of material to provide cushioning for the child in the high chair. It may be coated with a harmless water and/or stain repellent chemical. It may optionally have a vinyl or plastic-type layer at the bottom to capture spills and prevent liquid from seeping through the liner.

Folding Method

Figure 6:
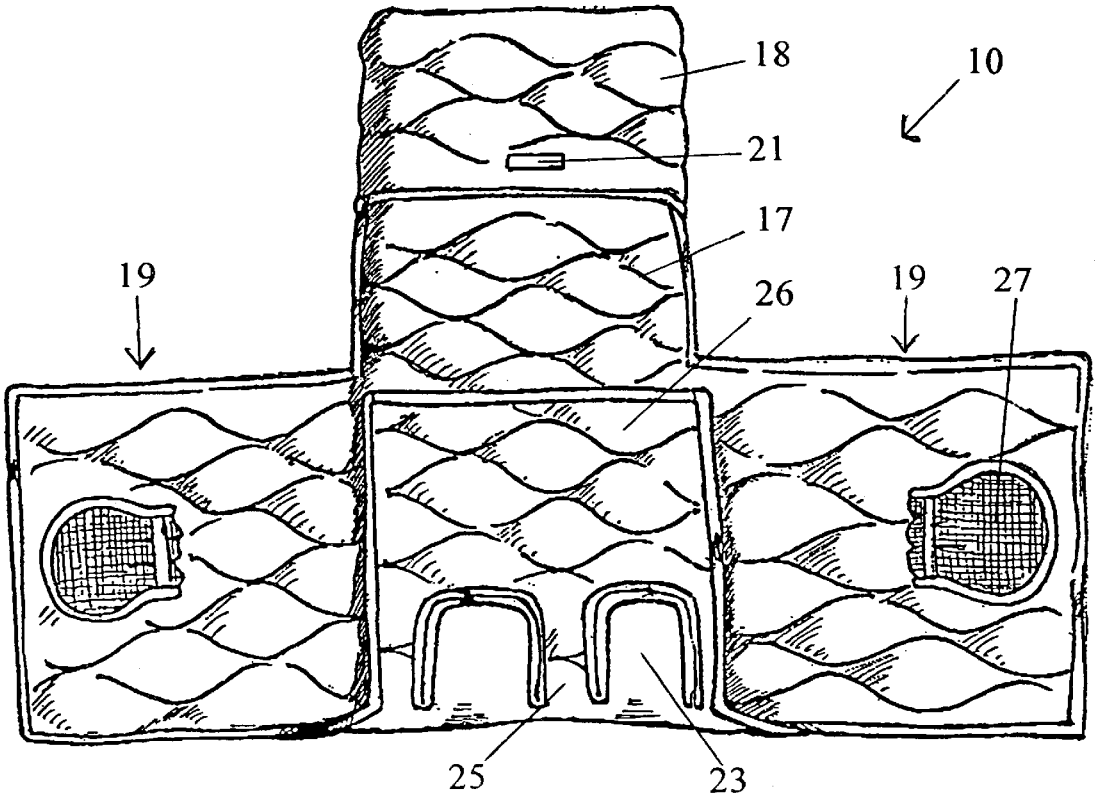
Figure 7:
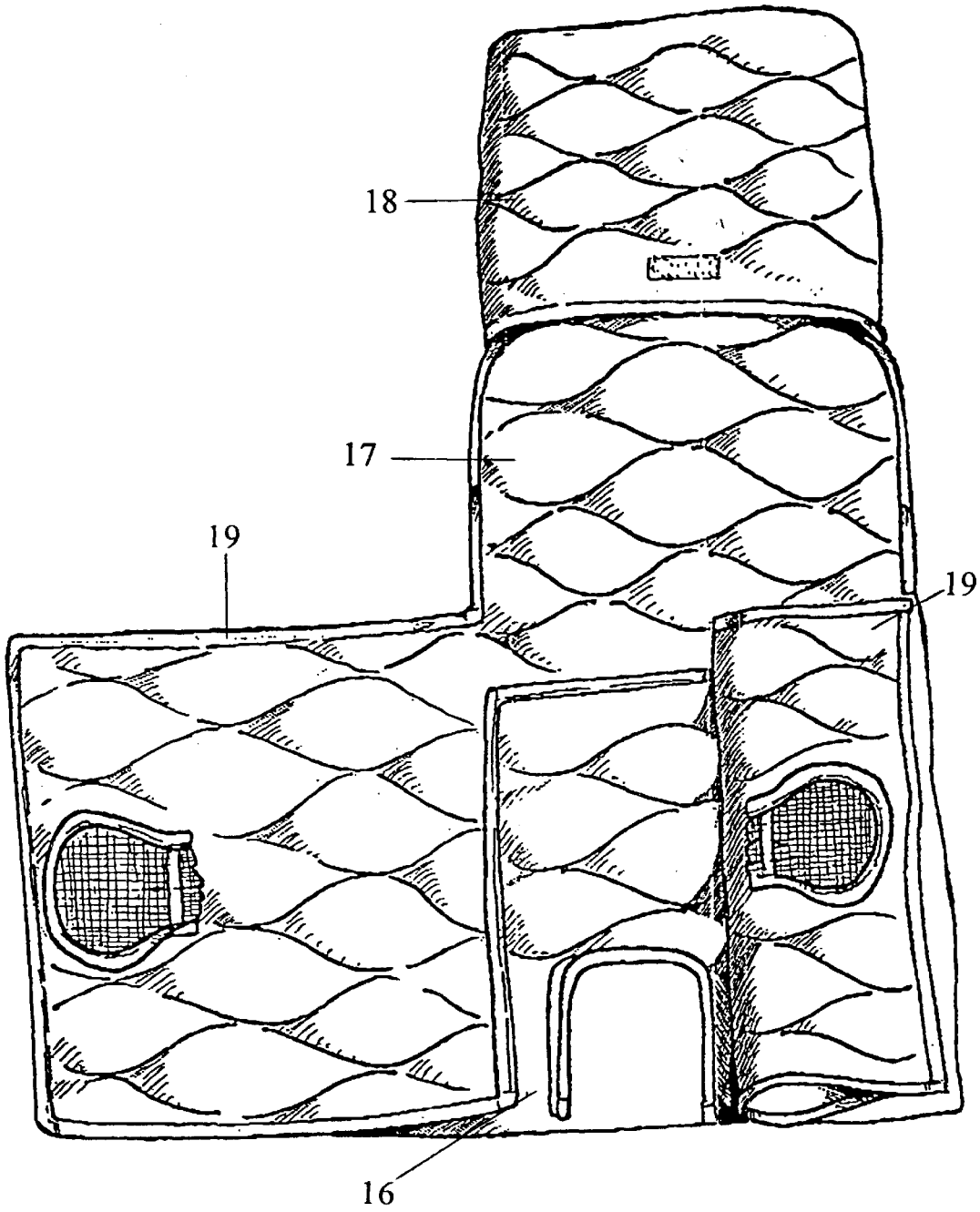
Figure 8:
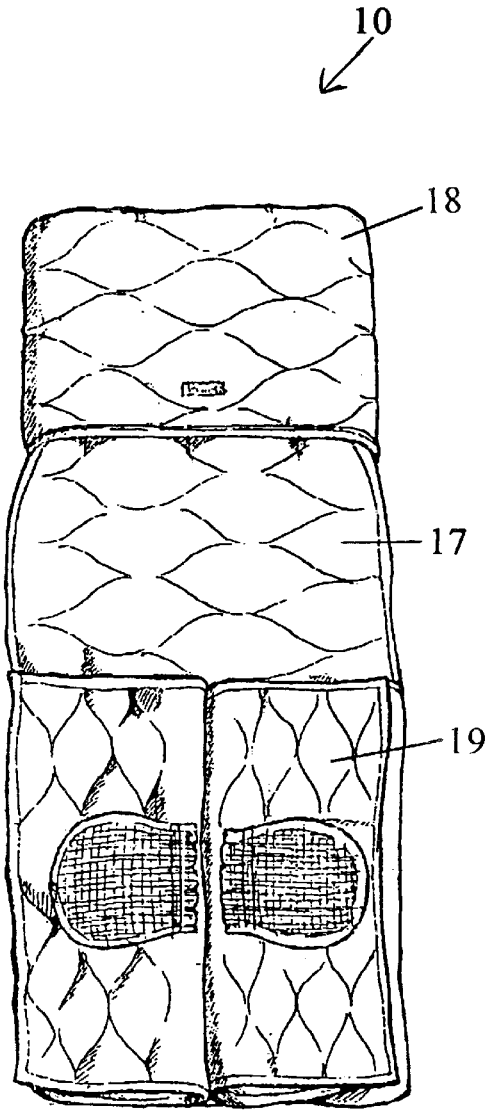
Figure 9:
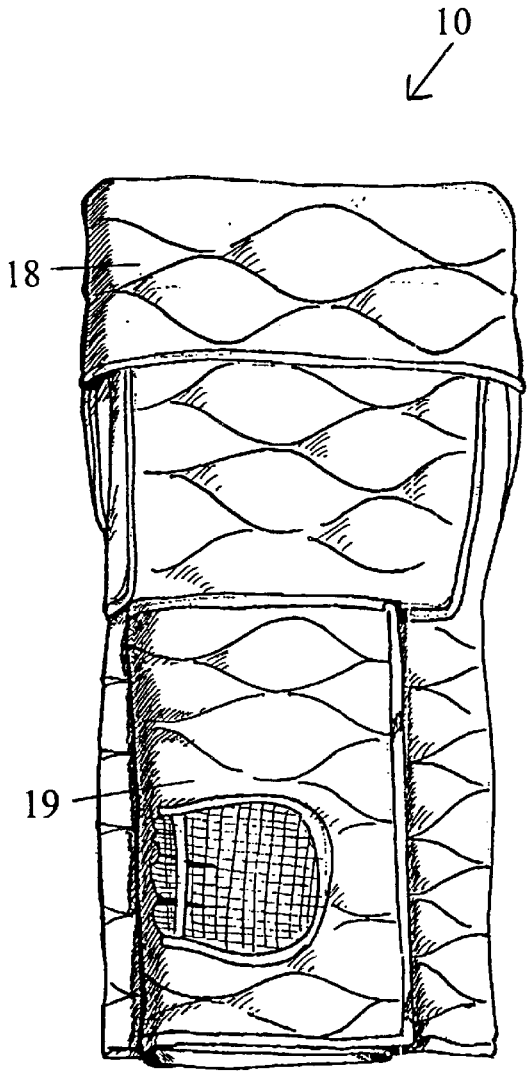

Referring to FIGS. 5–11, a series of views of the liner 10 shows a preferred folding sequence. The present invention also includes a method of folding a one-piece cover (liner) into a contiguous storage pouch. This method comprises the steps of:

a) providing a flat, flexible cover 10 that comprises a generally square seat portion 20, first and second corresponding arm portions 19 extending from opposite sides of the seat portion, a back portion 17 extending from a third side of the seat portion, and a front portion 16 extending from a fourth side of the seat portion, and a storage pouch 18 that extends from the back portion opposite to the seat portion;

b) folding the front portion onto the seat portion at a first latitudinal fold line 28 (see FIG. 5) between the seat portion and the front portion, as shown in FIG. 6;

c) folding the first arm portion about a first longitudinal fold line 29 along the center of the first arm portion;

d) folding the first, folded arm portion about a second longitudinal fold line 30 onto the front portion, as shown in FIG. 7;

e) folding the second arm portion about a third longitudinal fold line 31 along the center of the second arm portion, as shown in FIG. 8;

f) folding the second, folded arm portion about a fourth longitudinal fold line 32 onto the front portion, so that the second, folded arm portion is adjacent to the second, folded arm portion;

g) folding the second, folded arm portion, and the portions of the front and seat portions beneath it, about a fifth longitudinal fold line 33 under the first, folded arm portion, as shown in FIG. 9;

h) folding the arm portions, front portion, and seat portion about a second latitudinal fold line 34 onto the back portion, as shown in FIG. 10; and i) inserting the folded arm portions, front portion, seat portion, and back portion into the storage pouch 18. The storage pouch 18 may also have a flap with a fastener member which is fastened to a corresponding fastener member 21 on the front of the pouch as a last step in the above method, as shown in FIG. 11. In this fashion, the cover 10 will collapse to a fraction of its original size so that it is easy to carry and store.

Figure 12:
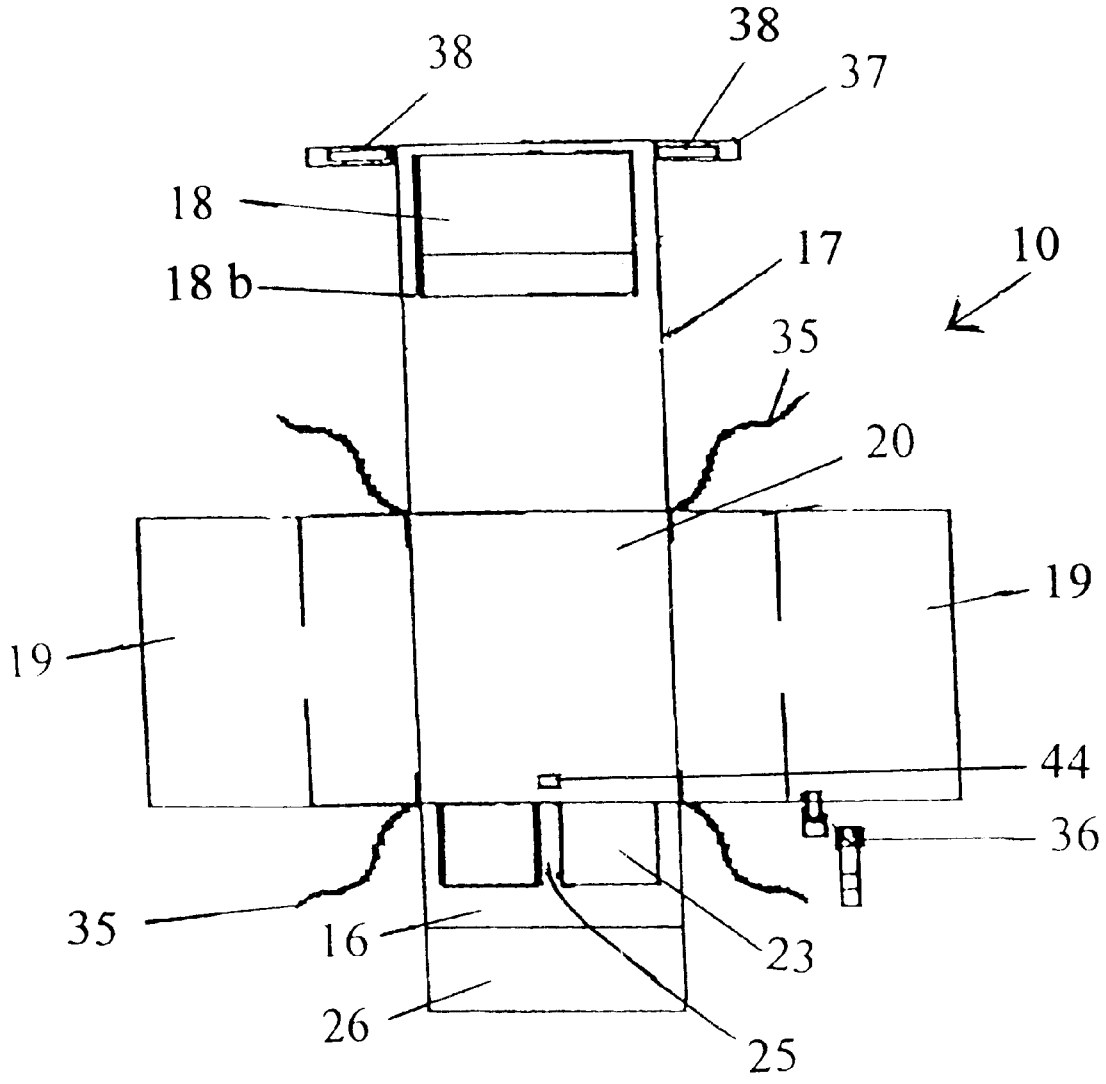
FIG. 12 is a top plan view of an alternate embodiment of a liner according to the present invention.
Figure 13:
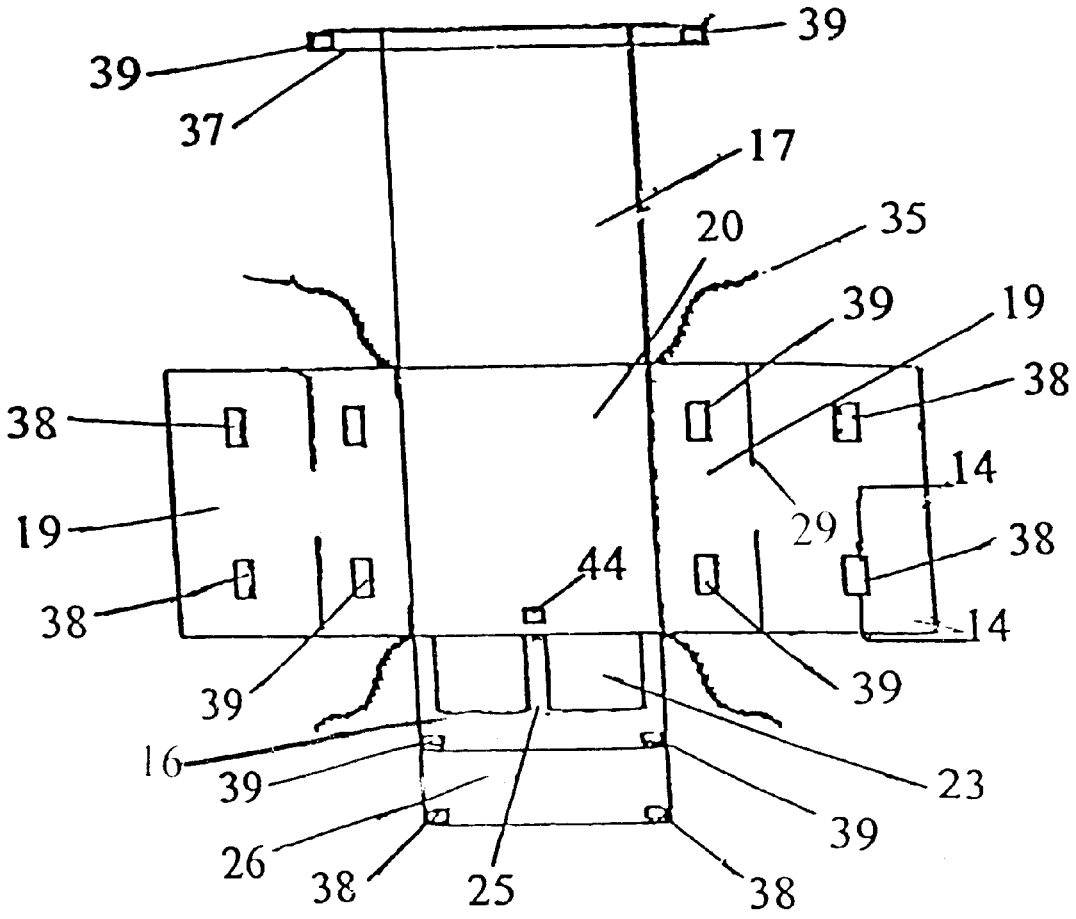
FIG. 13 is a bottom plan view of the liner according to FIG. 12.

An alternate, preferred, disposable embodiment of the present invention is shown from the top and bottom in FIGS. 12 and 13, respectively. The disposable liner 10 may be made of any suitable inexpensive, disposable materials. It may be constructed of a thin, plastic, reinforced paper, or a plurality of individual paper-type sheets laminated or fused together. It may be made from an absorptive center layer sandwiched between two colorful outer sheets of paper or the like. The outside of the bottom layer is preferably coated with a harmless adhesive for sticking the cover to the wooden high chair seat and back, so the child is less likely to slide around in, or out of, the highchair. Once the user is finished with the liner 10, the preferred adhesive easily peels away from the high chair without leaving a residue or otherwise damaging the chair. The liner fits smoothly against the chair or seat. The outside of the liner is preferably brightly colored, with a design printed on it that is attractive to a child. The materials used could also be man-made materials yet to be created.

Referring to FIGS. 12 and 13, the liner 10 is attached to the high chair by a suitable attachment mechanism, preferably by from one to four sets of fabric or string ties 35, or several short straps with lock and loop strips attached to the straps. The ties are preferably about eight to ten inches long. One set of two identical ties extends outwardly from each corner of the square seat portion 12. Each set of ties is tied around each of the four high chair legs when the cover 10 is placed on the chair.

Referring to FIG. 12, a pacifier attachment mechanism 36 is optionally attached at the front of one of the arm portions in the approximate center. A baby pacifier can be attached to this attachment mechanism. This is useful because pacifiers are often dropped or thrown by babies. With the attachment mechanism available, a pacifier is less likely to be lost or soiled by contact with the floor.

Referring to FIGS. 12 and 13, another option is an end strip 37 at the end of the back portion 17 with complementary lock and loop strips 38, 39 on the front (38) and back (39) of either end of the strip 37. These lock and loop strips attach to the bottom of the back of the high chair seat.

Referring to FIG. 12, the liner includes a storage pouch 18 with its opening **18*b* facing up, where it is accessible to the caregiver, when the liner is in use. The end of the liner having the storage pouch 18 hangs over the back of the chair, with its opening 18*b* at the top of the poach. Thus, the closed end of the storage pouch is nearest to the end strip 37, and the pouch opening 18*b* is at the opposite end of the storage pouch. As in other embodiments, the liner is foldable into its storage pouch 18**.

As shown in FIG. 13, lock and loop strips may also be attached to each arm portion 19. Most preferably lock and loop strips about three inches long are positioned in each of four quadrants on the arm portions. In use, two lock and loop strips 38 on each arm portion are pushed though an opening under the high chair arm to meet opposite lock and loop strips 39 in the opposite quadrants of the arm portion 19. Thus, the arm portions are removably secured to the high chair arms.

Referring further to FIG. 13, the front portion 16 also optionally includes lock and loop strips or other fastening means. Corresponding lock and loop strips 38, 39 are secured to the front portion, the end of the front portion (the lap bar flap 26) extends up over and around a lap bar of a high chair when the liner 10 is in use, and the lock and loop strips 38 along the end of the front portion are detachably secured to corresponding lock and loop strips 39 along central, outer edges of the front portion. In FIG. 13, corresponding lock and loop strips on the front portion 16 removably attach the two halves of the lap bar flap 26, once it is placed over the horizontal lap bar 14, to each other. Preferably, four lock and loop strips are attached along the edge on the bottom of the lap bar flap 26. Once the lap bar flap 26 is hanging over the horizontal lap bar, the two lock and loop strips 38 on the outside of the lap bar flap attach under the bar to opposite lock and loop strips 39 on the opposite side of the lap bar flap.

Referring to FIGS. 12 and 13, the seat portion 20 may further comprise a seat belt slot 44 adjacent and parallel to the first longitudinal fold line 29 close to the leg panels 23. The seat belt slot 44 is adapted for accommodating a seat belt in a liner for a baby carrier, child seat, or a baby car seat. Such chairs often have an attached seat belt which extends over the shoulders of the child in the chair/carrier. A short female or male seat belt member extends up from the middle part of the seat for attachment to an opposite seat belt member. Some chairs function as both a seat/carrier and a car seat.

It is desirable for the seat liner of the present invention to have certain attributes. It should be comfortable because babies often sit in high chairs for up to an hour during mealtimes, and are also often placed in high chairs for snacks and play activities. A caretaker may also place a baby in a nearby high chair while the caregiver is performing household tasks, such as cooking or cleaning. Of course, a child should never be left unattended or out of the caretaker's sight. This high chair liner is particularly advantageous, though, for use away from home, where the caregiver is concerned about dirt and "germs". It is transportable and easy to use, for example, in high chairs in restaurants, rental units, hotels, other people's homes, etc.

The liner should also be absorbent to absorb spills of liquids, etc. The high chair liner of the present invention is quite comfortable and absorbent. The reusable, washable embodiment of the present invention is made of a comfortable, padded material that wicks liquids away from the baby's skin. The disposable version has an upper layer that does not stick to the baby's skin. Liquid from spills, sweat, saliva, spit-up, etc. permeate through the upper layer and are absorbed by the center layer of absorbent material, so the baby is comfortable and his skin is kept dry. The lower layer preferably includes a plastic-type of backing so liquid does not puddle on the high chair seat.

The liner of the present invention acts as a physical barrier between the baby and the high chair, so transmission of viruses or bacteria from previous users or poor cleaning of the high chair is less likely. The physical barrier of the liner also shields the baby from physical contact with much of the high chair, so the baby is less likely to insert its fingers into crevices in the chair, be harmed by splinters, etc.

The cover 10 is versatile in that it can also used in baby strollers, such as the strollers for rent in many malls, in the small child's seat in shopping carts, also called grocery buggies, and in portable baby seats or carriers, and some baby/child car seats. It can also be used as a portable bag and pad/cover on changing tables, such as the fold-out changing tables found in many airport and mall restrooms. For use as a pad on a changing table, the cover is unfolded except for the arm portions and placed, fastener side down, on the changing table as a pad and cover for the table, with the bag acting as a pillow for the baby, as shown in FIG. 8. The cover 10 can be used in a baby stroller as it is in a high chair, except that the storage pouch 18 can be partially inverted over the back of the stroller, rather than hanging over the back for storage. This is helpful because the backs of many strollers are often taller than many high chair backs. Inverting the pouch portion of the cover over the back of the stroller helps prevent the cover 10 from falling down into the seat of the stroller.

Disposable Layers

Figure 14:
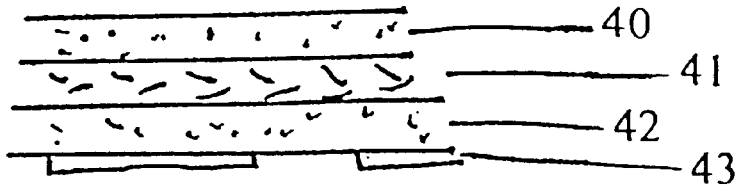
FIG. 14 is a cross-sectional view of the liner according to FIG. 13, taken along lines 14—14.

As shown in the FIG. 14 cross-section, a suitable disposable liner is comprised of three layers, including an upper layer 40, a middle layer 41, and a lower layer 42. The upper layer 40 is typically made of a flexible, liquid permeable, nonwoven material. A nonwoven fabric material or a porous plastic film material may be employed. The upper layer is preferably comprised of a paper material, and may be made of multiple layers of paper laminated together. It may be covered with, or made of, a thermoplastic material. This is the layer that contacts the baby's skin, so it must be comfortable and nonallergenic.

The upper layer 40 allows liquid to flow through it and into the middle layer 41, which is made of an absorbent core material. The absorbent core material is preferably comprised of pulp fibers, or a mixture of pulp and polymer particles with high water absorptivity. The absorbent core material may be a combination of thermoplastic material and other fibers, such as pulp fibers. During manufacture the layers are typically heated so that the layers thermoform and bond to each other. Alternatively, the upper and lower layers 40, 41 are placed on either side of the middle layer and continuously or intermittently bonded together using hot melt or other suitable adhesive along their periphery. The periphery of the liner physically extends beyond the absorbent middle layer, so the upper layer binds to the lower layer.

Continuing with FIG. 14, the lower layer 42 may be made of a plastic film material or a laminate of a plastic film material and a nonwoven fabric material. The outside of the lower layer 42 includes either a thin layer, or patches, of a detachable adhesive material 43 that is not harmful to humans. After use, the disposable liner can easily be detached from the chair by peeling it away from the seat and/or back. The upper layer is visible to others and preferably has a colorful design printed on it. This layer may be made of any suitable man-made materials.

Benefits

Another desirable attribute of a child seat liner is that it provides partial insulation for the baby from hot and cold temperatures in the room. The liner of the present invention protects the baby's skin somewhat from a cold or hot high chair or other type of child seat, which might have been, for example, stored in a window or by an air conditioner. If the baby was sweating from a hot car, summer temperatures, or hot clothing, the liner of the present invention helps to cool the baby and absorb sweat, particularly the disposable embodiment. The reusable, washable embodiment is particularly comfortable where the ambient temperature, or the temperature in an air conditioned room, is cold.

Still another desirable attribute of a child seat cover is durability. The fabric embodiment must maintain its integrity even after multiple uses and washings, and the disposable embodiment must not rip or lose its shape until after it has been used. On the other hand, the disposable embodiment must be environmentally friendly, and suitable for landfill or incineration, once it has been disposed of. The disposable embodiment is also inexpensive and cost effective to manufacture.

From the foregoing it can be realized that the described device of the present invention may be easily and conveniently utilized as a cover for a high chair, child's chair, portable baby seat, baby carrier, or baby stroller, or as a traveling bag and pad for a changing table. It is to be understood that any dimensions and applications given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS (For information only)

10 chair/seat liner
11 high chair
12 high chair footrest
13 high chair front legs
14 high chair horizontal lap bar
15 high chair lap strap
16 front portion
17 back portion
18 storage pouch
19 arm portions
20 seat portion
21 storage flap closure means
22 carrying strap
23 leg panels
24 leg slots
25 crotch strip
26 lap bar flap
27 side pockets
28 first latitudinal fold line
29 first longitudinal fold line
30 second longitudinal fold line
31 third longitudinal fold line
32 fourth longitudinal fold line
33 fifth longitudinal fold line
34 second latitudinal fold line
35 ties
36 pacifier attachment mechanism
37 back end strip
38 lock and loop strips
39 opposing lock and loop strips
40 upper layer
41 middle layer
42 lower layer
43 detachable adhesive
44 seat belt slot

What is claimed is:

1. A one-piece, flexible liner in combination with high chair or child seat, comprising:

a) a central, generally square-shaped seat portion;

b) a pair of arm portions extending from opposite sides of the seat portion;

c) a front portion extending from a third side of the seat portion;

d) a generally rectangular-shaped back portion extending from a fourth side of the seat portion opposite to the front portion;

e) one or more fastening mechanisms for detachably attaching the liner to the high chair or child seat; and f) a storage pouch extending continuously from an end of the back portion;

wherein, when the liner is in use, the storage pouch hangs over the back of the high chair or child seat, the storage pouch opening being at the top of the high chair of child seat; and wherein the liner is foldable into the storage pouch.

2. A one-piece, flexible liner according to claim 1, wherein the front portion of the liner comprises leg slots forming two identical, spaced apart, generally U-shaped leg panels, with a thin crotch section extending between the leg panels, the ends of the U-shaped leg panels bordering on a first latitudinal fold line between the seat portion and the front portion.

3. A one-piece, flexible liner according to claim 2, without cloth hinges, or snap fasteners attached to the edge of the pad along the storage pouch and back portion; and wherein the child chair or seat is a high chair.

4. A one-piece, flexible liner according to claim 3, wherein the end of the front portion comprises fastening means and attaches around a lap bar of the high chair when the liner is in use.

5. A one-piece, flexible liner according to claim 3, wherein corresponding strips of lock and loop, or snap members are secured to the underside of the arm portions for fastening the arm portions over the high chair arms to the remainder of the arm portion.

6. A one-piece, flexible liner according to claim 2, wherein the liner is comprised of two layers of fabric overlaid on one another, and the storage pouch is an inverted end of the back portion.

7. A one-piece, flexible liner according to claim 1, wherein the child chair or seat is a baby carrier, portable baby seat or car seat.

8. A one-piece, flexible liner according to claim 7, wherein the seat portion comprises a seat belt slot adjacent and parallel to the first longitudinal fold line, the seat belt slot being adapted for accommodating a seat belt.

9. A one-piece, flexible liner according to claim 4, further comprising a pacifier attachment mechanism detachably attached to the front of one of the arm portions; and side storage pockets disposed on the arm portions.

10. A one-piece, disposable child seat liner for a child seat or chair, the liner comprising:

(a) an upper layer of flexible, liquid permeable sheet material;

(b) a middle layer of an absorbent core material; and (c) a lower layer of liquid impermeable material;

wherein the outside of the lower layer comprises a detachable adhesive adapted for contacting the child seat; and wherein the liner further comprises a generally rectangular-shaped seat portion bordered by a back portion on one side, a front portion on an opposite side, and two arm portions on opposite sides of the seat portion; and wherein the front portion of the liner comprises leg slots forming two identical, spaced apart generally U-shaped leg panels, with a thin crotch section extending between the leg panels.

11. A one-piece, disposable child seat liner according to claim 10, wherein the back portion further comprises a storage pouch having an opening facing up when the liner is in use, the remainder of the liner being foldable into the storage pouch.

12. A one-piece, disposable child seat liner according to claim 11, further comprising an end strip at the end of the back portion, complementary lock and loop strips being attached to the front and back of the ends of the end strip, the lock and loop strips being attachable to the bottom of the back of the child seat.

13. A one-piece, disposable child seat liner according to claim 11, wherein the liquid permeable sheet material is comprised of a paper material or a thermoplastic material.

14. A one-piece, disposable child seat liner according to claim 10, wherein the absorbent core material is comprised of pulp fibers, or a mixture of pulp and polymer particles with high water absorptivity.

15. A one-piece, disposable child seat liner according to claim 10, wherein the liquid impermeable material is comprised of a plastic film material, or a laminate of a plastic film material and a nonwoven fabric material.

16. A one-piece, disposable child seat liner according to claim 11, wherein the periphery of the liquid permeable material and the liquid impermeable material physically extend beyond the periphery of the absorbent middle layer, and are adhered to one another.

17. A one-piece, disposable child seat liner according to claim 16, further comprising a carrying strap for carrying the storage pouch with the liner in it, the carrying strap being attached at its opposite ends to the storage pouch; and wherein the child seat or chair is a baby stroller or a child's seat of a shopping cart.

18. A one-piece, disposable child seat liner according to claim 11, wherein the front portion of the liner comprises leg slots forming two identical, spaced apart, generally U-shaped leg panels, the ends of which border on a first latitudinal fold line between the seat portion and the front portion.

19. A one-piece, disposable child seat liner according to claim 18, with corresponding lock and loop strips secured to the front portion, the end of the front portion extending up over and being removably fastenable around a lap bar of the high chair when the liner is in use, and the lock and loop strips along the end of the front portion are detachably secured to corresponding lock and loop strips along central, outer edges of the front portion.

20. A method for folding and storing a cover for a child seat or chair, comprising the steps of:

a) providing a flat, flexible cover that comprises a generally square seat portion, first and second corresponding arm portions extending from opposite sides of the seat portion, a section extending from a third side of the seat portion, and a front portion extending from a fourth side of the seat portion, and a storage pouch that extends from the back portion opposite to the seat portion;

b) folding the front portion onto the seat portion at a first latitudinal fold line between the seat portion and the front portion;

c) folding the first arm portion about a first longitudinal fold line along the center of the first arm portion;

d) folding the first, folded arm portion about a second longitudinal fold line onto the front portion;

e) folding the second arm portion about a third longitudinal fold line along the center of the second arm portion;

f) folding the second, folded arm portion about a fourth longitudinal fold line onto the front portion, so that the second, folded arm portion is adjacent to the second, folded arm portion;

g) folding the second, folded arm portion, and the portions of the front and seat portions beneath it, about a fifth longitudinal fold line under the first, folded arm portion;

h) folding the arm portions, front portion, and seat portion about a second latitudinal fold line onto the back portion; and i) inserting the folded arm portions, front portion, seat portion, and back portion into the storage pouch.

* * * * *